US007641574B2

(12) United States Patent
Steen

(10) Patent No.: US 7,641,574 B2
(45) Date of Patent: Jan. 5, 2010

(54) 21st CENTURY CHALLENGE AMERICA BASKETBALL GAME

(76) Inventor: John Burton Steen, 824 Crossfire Ct., Marietta, GA (US) 30064

( * ) Notice: Subject to any disclaimer, the term of this patent is extended or adjusted under 35 U.S.C. 154(b) by 0 days.

(21) Appl. No.: 12/231,539

(22) Filed: Sep. 3, 2008

(65) Prior Publication Data

US 2009/0005195 A1 Jan. 1, 2009

Related U.S. Application Data

(63) Continuation-in-part of application No. 11/786,901, filed on Apr. 13, 2007, now Pat. No. 7,507,170.

(51) Int. Cl.
*A63B 67/00* (2006.01)

(52) U.S. Cl. ..... 473/472

(58) Field of Classification Search ..... 473/472, 473/470, 471, 465, 415, 447, 569; 40/327; 273/400

See application file for complete search history.

(56) References Cited

U.S. PATENT DOCUMENTS

| | | | | |
|---|---|---|---|---|
| 4,171,808 | A | 10/1979 | Bauer | |
| 5,388,821 | A | 2/1995 | Blackburn | |
| 5,549,293 | A | 8/1996 | Seifert | |
| 5,601,284 | A | 2/1997 | Blackwell et al. | |
| 5,893,809 | A | 4/1999 | Coats et al. | |
| 6,390,940 | B1 | 5/2002 | Naulls et al. | |
| 7,270,617 | B2 | 9/2007 | Henning | |
| 7,507,170 | B1 * | 3/2009 | Steen | 473/472 |
| 2006/0068945 | A1 | 3/2006 | Murchison, III | |

OTHER PUBLICATIONS

Webpage download, NBA Rules,2006, www.nba.com/analysis/rules_1.html?nav=ArticleList, 2 pages.*
Webpage download, whyNot 4-point,2007, www.whynot.net/ideas/3306, 1 page.*
Webpage download, BetterBasketball, 2004, www.betterbasketball.com, 3 pages.

* cited by examiner

*Primary Examiner*—Gene Kim
*Assistant Examiner*—M Chambers
(74) *Attorney, Agent, or Firm*—H Brock Kolls

(57) ABSTRACT

The present invention relates to a method of playing basketball and in particular to a method comprising providing a rectangular region defining a game play surface; providing a goal defined by a hoop located over each the in paint region; and scoring points during game play as follows: a player standing, within the in paint region, and shooting a ball through the goal scores one point; the player standing, within region between the in paint region and the three-point line, and shooting the ball through the goal scores two points; the player standing, within region between the three-point line and the four-point line, and shooting the ball through the goal scores three-points; and the player standing, within the four-point region, and shooting the ball through the goal scores four-points.

6 Claims, 4 Drawing Sheets

-ALL LINES SHALL BE 2 INCHES WIDE (NEUTRAL ZONES EXCLUDED)
-THE COLOR OF THE LANE SPACE MARKS AND NEUTRAL ZONES MARKS SHALL CONTRAST WITH THE COLOR OF THE LANE BOUNDARY MARKS

THE COURT

21st CENTURY CHALLENGE AMERICA BASKETBALL GAME

RELATED APPLICATIONS

This application contains subject matter which is related to the subject matter of the following co-pending application. Furthermore, the below listed application is hereby incorporated herein by reference in its entirety:

The present application is a continuation-in-part of an application entitled "21st CENTURY CHALLENGE AMERICA BASKETBALL GAME", Inventor John Burton Steen, filed Apr. 13, 2007, Ser. No. 11/786,901 now U.S. Pat. No. 7,507,170.

TECHNICAL FIELD OF THE INVENTION

The present invention relates to a method of playing a basketball game and in particular to making the game more challenging and rewarding for the players and to improve specifically their ball-handling and shooting skills. Thus, several aspects of the old game have been changed to address these issues.

BACKGROUND OF THE INVENTION

This invention addresses the sports game invented by Dr. James A. Naismith in 1891 at Springfield College, Springfield Massachusetts. His selection of the thirteen rules of the game was to facilitate the function of an exercise activity. No consideration was given to playing, court size, basket (goal) height, male versus female adaptability, future human species physical demographics, male versus female genetics, potential youth-age adaptability, academic scholarships, professional adaptation, added value, player performance, maintenance of essential facilities and rules to maintain the necessary value of the game and to support the intrinsic and historical value to all.

With the obvious concern of those in charge, even the one apparent progressive rule addition in 1987 of the three-point radial shot from eighteen feet has, after approximately 25 years, thus far been diluted by the continued NCAA administration of 50-75 years of the questionably used "mini-rules" management changes. The length of the three-point shot is now experimentally up to twenty feet nine inches for men and nineteen feet nine inches for women players. Dr. Ed Steitz was the athletic director at Springfield College and spent about five years on the rules committee to get this rule approved. My sense of court balance is that eighteen feet was the right distance in order to help reduce the player basket density. The 1977 rule change to allow dunking was implemented after the nine year NCAA ban. This rule was a result of Texas Western dunking themselves to a national championship over Kentucky in 1966.

Levels of play have relinquished the need for both player performance and balanced player improvement. Player growth and performance now centered on player height, not shooting and ball-handling development. "Dunking the ball"—so-called points in the paint—has become the standard.

There is a long felt need to prevent the stagnation of the game of basketball by preventing the dunk from further destroying the game, by opening the game to shorter players and accommodating various players' skill levels, by making the game more challenging and rewarding for the players, and to improve specifically their ball-handling and shooting skills, which in part gives rise to the following invention.

SUMMARY OF THE INVENTION

The shortcomings of the prior art are overcome and additional advantages are provided through the provision of an improved method of playing basketball, the improved method comprising: transforming a rectangular region into a game play surface; constructing the game play surface comprising: two opposite sides of the rectangular region are an end line, a division line is disposed equal distance between each of the end line, the game play surface dimensions are determined by a team classification; each of an in paint region, a three-point line placed on sides of the in paint region and having an elliptical arc extending above the in paint region enhancing transition zone play between the three-point line and the division line, and a four-point line proximate and parallel the division line creating a four-point region are located within and at opposite ends of the game play surface, a goal defined by a hoop located over each of the in paint region, the hoop is located at a fixed distance above the in paint region; setting the fixed distance minimum height as follows: the fixed distance is ten feet one inch for general playground, elementary school, junior high school, and high school said team classification; eleven feet for junior college, college division NAIA the team classification; twelve feet for college division III the team classification; thirteen feet for college division II the team classification; fourteen feet for college division I the team classification; fifteen feet for professional the team classification; and fifteen feet eleven inches for professional assisted team classification; recording a team score on a device during a game play time period; and scoring points during the game play time period comprising: a player standing, within the in paint region, and shooting a ball through the goal scores one point; the player standing, within region between the in paint region and the three-point line, and shooting the ball through the goal scores two points; the player standing, within region between the three-point line and the four-point line, and shooting the ball through the goal scores three-points; and the player standing, within the four-point region, and shooting the ball through the goal scores four-points.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1A:
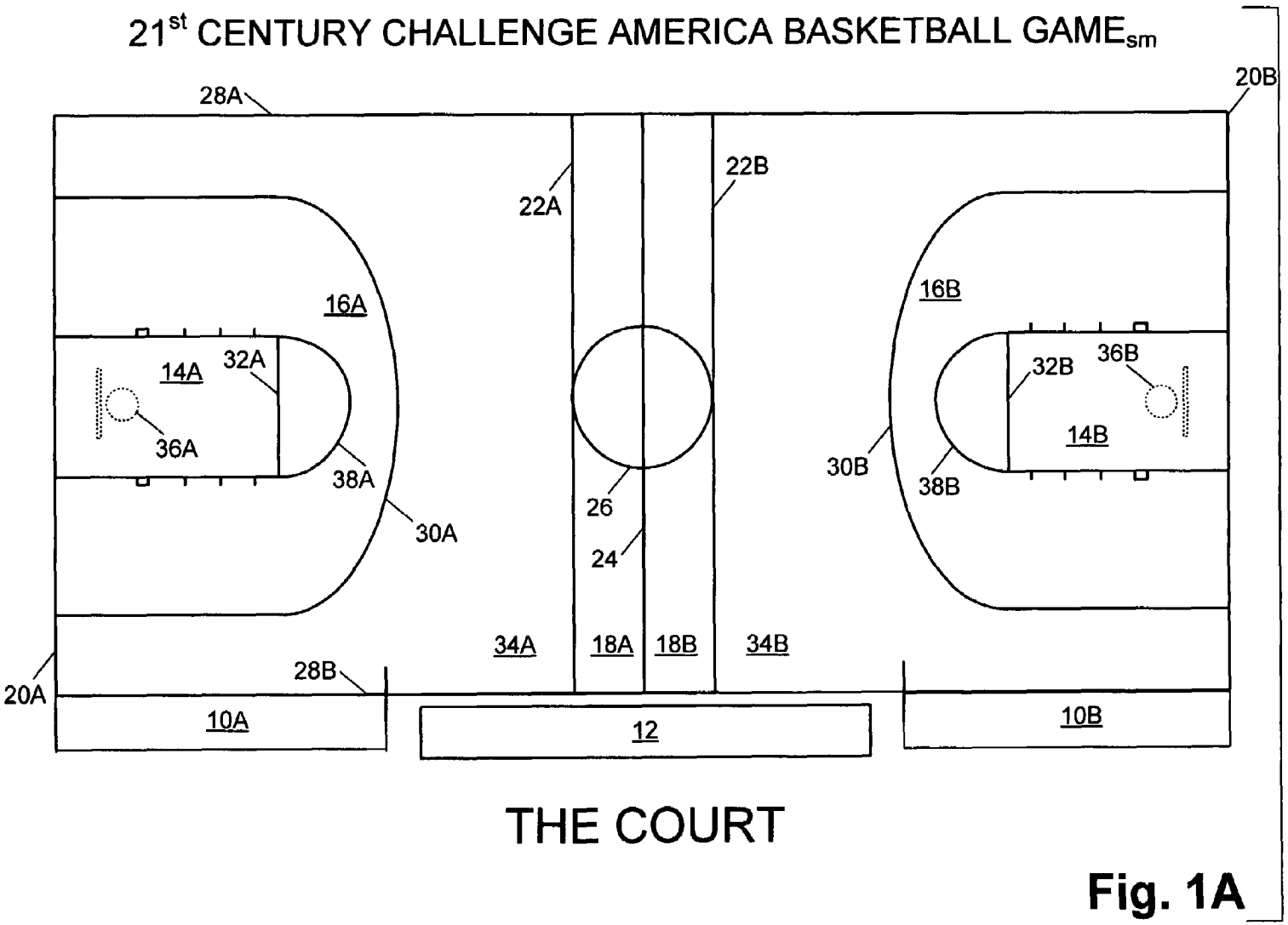
FIG. 1A illustrates one example of a basketball game court.

The detailed description explains the preferred embodiments of the invention, together with advantages and features, by way of example with reference to the drawings.

REFERENCE NUMERALS IN THE DRAWING

10A and 10B coaching boxes
12 scorers table
14A and 14B in paint region also referred to as free throw lane 14A and 14B
16A and 16B three-point region
18A and 18B four-point region
20A and 20B end line
22A and 22B four-point line
24 division line also referred to as center of the court 24
26 center circle
28A and 28B side line
30A and 30B three-point line
32A and 32B free throw line
34A and 34B transition zone region
36A and 36B goal also referred to as basket 36A and 36B
38A and 38B top of key line

DETAILED DESCRIPTION OF THE INVENTION

Turning to the present invention, referring to FIG. 1A there is illustrated one example of a basketball game court. In an exemplary embodiment, the game court includes coaching boxes 10A and 10B, scorers table 12, in paint region 14A and 14B also referred to as free throw lane 14A and 14B, three-point region 16A and 16B, four-point region 18A and 18B, end line 20A and 20B, four-point line 22A and 22B, division line 24, center circle 26, side line 28A and 28B, three-point line 30A and 30B, free throw line 32A and 32B, transition zone 34A and 34B, goal 36A and 36B also referred to as basket 36A and 36B, and top of key line 38A and 38B.

Figure 1B:
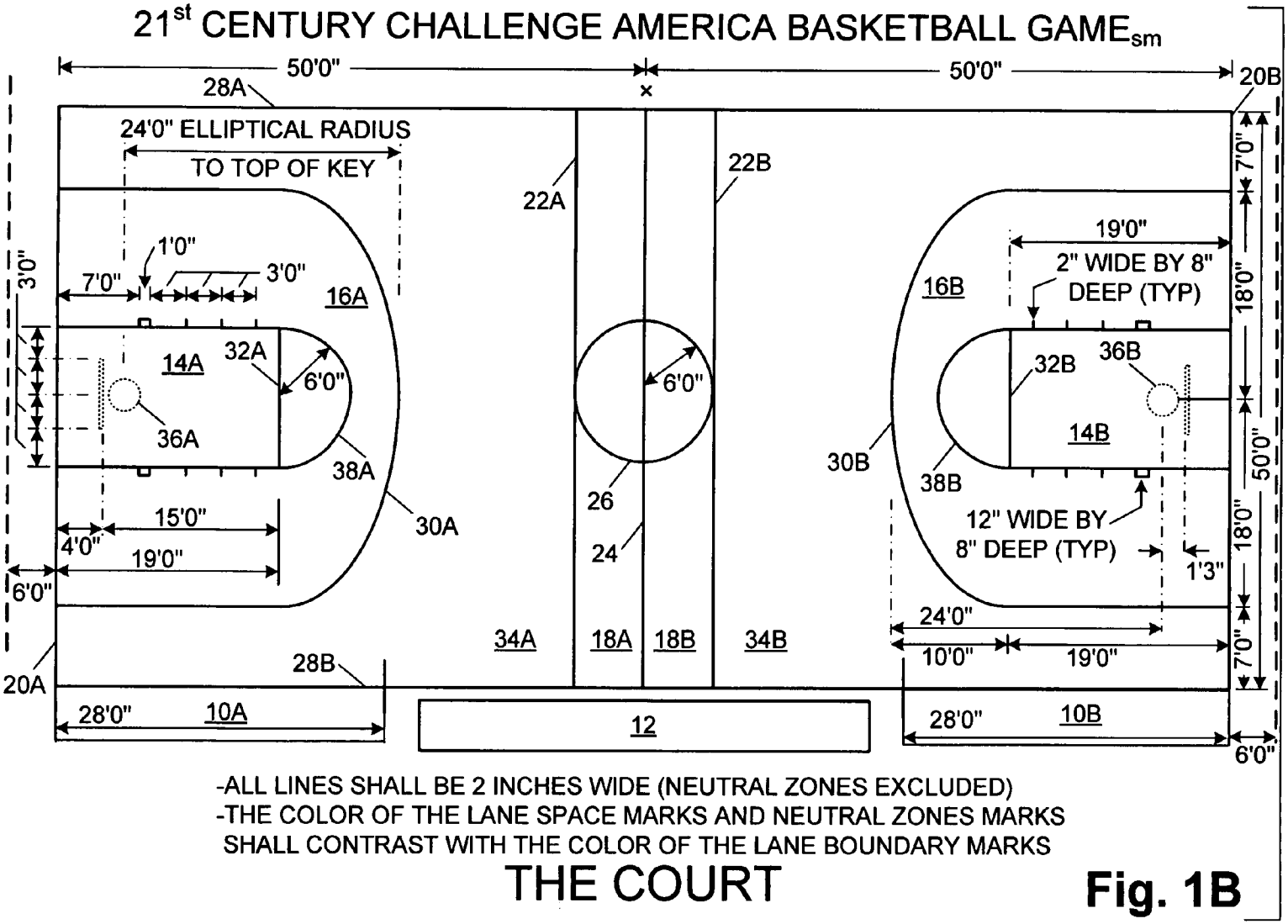
FIG. 1B illustrates one example of a basketball game court, wherein an exemplary embodiment is illustrated including certain dimensional game court characteristics.

Referring to FIG. 1B there is illustrates one example of a basketball game court, wherein an exemplary embodiment is illustrated including certain game court dimensional characteristics.

In an exemplary embodiment the basket or goal 36A-36B height can vary based on team classification. An advantage of selectivity of basket height and mutual agreement of height to be used can strengthen the 21$^{st}$ Century Challenge America Game play as outlined in Table 1 below:

TABLE 1

| Class | Team Classification | Minimum Basket Height | Minimum Court Size Length |
|---|---|---|---|
| 1 | General Playgrounds | Ten feet one inch | Seventy feet by forty feet |
| 2 | Elementary Schools | Ten feet one inch | Seventy feet by forty feet |
| 3 | Jr. High Schools and the like | Ten feet one inch | Seventy feet by forty five feet |
| 4 | High Schools and the like | Ten feet one inch | Ninety feet by fifty feet |
| 5 | Jr. College and the like | Eleven feet | One hundred feet by fifty feet |
| 6 | College Division NAIA | Eleven feet | One hundred feet by fifty feet |
| 7 | College Division III | Twelve feet | One hundred feet by fifty feet |
| 8 | College Division II | Thirteen feet | One hundred feet by fifty feet |
| 9 | College Division I | Fourteen feet | One hundred feet by fifty feet |
| 10 | Professional and the like | Fifteen feet | One hundred feet by fifty feet |

TABLE 1-continued

| Class | Team Classification | Minimum Basket Height | Minimum Court Size Length |
|---|---|---|---|
| 11 | Professional assisted and the like | Fifteen feet eleven inch | One hundred feet by fifty feet |

Any classification can be selectively paired to compete at any basket height in classes six thru nine. Classes ten and eleven can be paired. Class eleven can use player entertainment assists in making a basket.

In another exemplary embodiment the various regions of the game play court can be colored. Such color can be selected such that certain colors correspond to certain basket heights. As an example and not a limitation a red colored in paint region can correspond to a basket goal height of fourteen feet, and a blue colored in paint region can correspond to a basket goal height of fifteen feet.

An advantage is that a player can then determine the height of the basket goal by the color of certain of the regions on the game play court. Different colors can be used in different regions, as may be required and/or desired in a particular embodiment.

In another exemplary embodiment the height of the goal can be determined by the crowd. In this regard, the crowd can be utilized to influence the basket goal height requesting a goal height adjustment before and/or during game play, as may be required and/or desired in a particular embodiment.

An advantage is that crowd participation can be used to modify goal heights which can indirectly increases or decrease player shooting skills and scoring, resulting in changing the game play dynamics to make the game more enjoyable to watch and/or play.

In another exemplary embodiment the goal heights for each of two teams can be set to different heights. In this regard, when height, skill, or other differences exist between two teams the goal height can be adjusted for one team to give them a game play, skill, scoring, and/or other advantage, as may be required and/or desired in a particular embodiment.

An advantage is that unequally skilled teams can play against each other in a competitive manner by adjusting the height of the goal for one team to provide a game play advantage, thus providing a more equal and fair game play circumstance.

21$^{st}$ Century Challenge America Basketball Game play uses three new rules including: one point scored in the paint; eighteen to twenty-four feet at base line to top of key three-point shot; and basket height for Class six thru nine to be mutually agreed upon at scheduling prior to the start of the season.

The present invention addresses the out-of-date standards and makes the game of basketball more challenging. Moreover, it simultaneously enhances player performance, scoring, and ball handling skills. In this regard in an exemplary embodiment:

The three-point shot line is again placed at Dr. Ed Steitz's eighteen foot distance. It is now coupled to an elliptically shaped 56.25 degree arc enhancement located nineteen feet from the end of the court to the center of the basket. The shot gets longer (up to twenty-four feet) as the ball handler moves toward the center of the court to the top of the key;

The length of the basketball court is extended from the current ninety-four feet to one hundred feet to improve transitional play and accommodate the new three-point elliptically-designed shot as described above;

To prevent the dunk from further destroying the game, scoring values have been reassigned so that only one point is awarded for dunks and other shots made "in the paint"; whereas up to four-points can be earned for successful attempts originating "outside the paint". A four-point zone of twelve feet; six feet on either side of the center of the court is illustrated in FIG. 1B. During game play the backcourt violation will occur against the offensive team if they go back over the "four-point line line" located in the offensive teams defensive zone thus increasing the transition zone size; and To accommodate various players' skill levels from elementary, junior high and high school, the basket will be placed at a height of ten feet one inch. College height will range from eleven feet to fourteen feet for the four divisions as illustrated in Table 1. The professional game is played with a basket height at fifteen feet. A height of fifteen feet eleven inches will be allowed for special occasions or entertainment reason/needs. Professional teams will be encouraged to sign up to play 21$^{st}$ Century Challenge America Basketball.

With the installation of the higher baskets, players will be required to improve their shooting, ball handling, and floor play-making maneuvers rather than let the points "in the paint" continue to dominate the once unique strategy of the game.

The 21$^{st}$ Century Challenge America Basketball Game has been invented to make the game more challenging and rewarding for the players and to improve specifically their ball-handling and shooting skills. Thus, several aspects of the old game have been changed to address these issues. In this regard in an exemplary embodiment:

The three-point shot, eighteen foot side line has been reinstated and is combined with an elliptical enhancement so that the shot will be longer from eighteen feet to twenty-four feet as the player moves towards the center of the court to the top of the key. FIGS. 1A and 1B illustrate the full court including this and other designated changes; and The court is extended from ninety-four feet to one hundred feet to improve transition play and accommodate the use of the new elliptically shaped, three-point shot arc. The introduction of a "four-point line line" further extends game play scoring options in that a player on offense may launch the ball in a talented "hail-mary" shot, for example anywhere in front of the four-point line on the opponents end of the court to score four points.

The "four-point line line" fixes the backcourt rule in each direction of play. The "four-point line line" increases interest in talented scoring and transition play in this twelve foot by fifty foot section across the court in setting up for offensive play action.

Also baskets made "in the paint" will be rewarded only one point. This change is designed to encourage the player "outside the paint" to shoot from a distance that will receive two-points or more points instead of one point. This will in turn move players from beneath the basket and enable the referees to officiate the game with more accuracy and take less time to confer to make the correct call, which will alleviate some of the discord of the game delay.

In an exemplary embodiment, the height of the basket is increased and may now be placed at heights ranging from ten feet one inch to fourteen feet depending upon Class and Division level of play. Raising the basket for all levels of play will result in a more challenging game for the player and a more entertaining game for the spectators. In case of games scheduled between different Divisions one and four levels of play, a height of eleven feet to fourteen feet can be agreed upon and depending on inter-conference or conference rules for heights can be used. Heights are designed for professional use, for standard, and entertainment levels of play as illustrated in Table 1.

One of the intents of the present invention is to keep the game of basketball alive and prevent its 115 years of game play from causing a stalemate and stagnation due to things that Dr. James A. Naismith could not have possibly foreseen. As an example, a factor such as physical size of the players has dramatically changed over the years. In this regard, taller players and dunk shots have grown and are prevalent in the game today. This dominance of player height and dunk shots has reduced the skill and strategy aspects of the game and has excluded smaller player from playing the game.

One feature of the present invention to improve game play is to go back to Dr. Ed Steitz's eighteen foot three-point shot from the side but now modify the three point shot by coupling the eighteen foot three-point shot from the side with a 56.25 degree arc. This means that a player has to shoot twenty-four feet at the top of the key versus eighteen feet.

Use of the elliptical arc to gradually increase the distance requires constant adjustment by the shooter as his position is constantly changing as he moves back down the court, requiring creative advanced player achievement.

Transition zone play is under constant pressure and more court space is needed. In this regard, in an exemplary embodiment, once the half court line is crossed by an offensive player with the ball, the offensive player can be allowed to retreat with the ball back to the opponents "four point line line" before a backcourt violation occurs. In an exemplary embodiment this adds the size of the opponents four point region to the transition zone size, which increases the transition zone play region and enhances transition zone game play. The "hail-mary" shot is not affected on offense but longer challenging shots and excitement are encouraged.

The dominance of the dunk is diminished by awarding only one point for "in the paint" shots. This encourages the players to shoot a short shot outside the "in the paint" region, creating more shooting skills around the basket and taking away close in crowded "in the paint" area shooting. Dunking will be one point and the players then have a choice of how to score. An advantage is that this new game will have more room for the shorter players and as a result more school scholarships will be available to them.

In an exemplary embodiment, the basket is positioned at higher heights which will increase the value of player skill and performance benefiting men, women, tall, and short players. Division standards will accommodate more varieties of players and offer higher goals for participation at many levels. As coaches begin to develop offensive and defensive strategies to take advantage of the present invention game play regions and scoring, coaching game play insights and game play comprehension will improve, as a result more ways to take advantage and play the game will be developed. Such developments will continue to enhance game play and advance other tactical and technical aspects of the present invention, which will result in a more rewarding experience for coaches, players, and fans. The present invention will give our historic game back and make players have to shoot, ball handle, and play make using transition play with more available space. An advantage of the present invention is that it is not how tall you are; it is how you can use the physical size you are to advantageously exploit aspects of game play.

The result of the totally new game of the present invention is a greater challenge for the players, enhanced ball-handling and shooting skills required to play the game, and greater excitement for the spectators. In an exemplary embodiment, the specific aspects that have been created are the following:

- The three-point line is placed on the side at eighteen feet and is used in conjunction with a 56.25 degree elliptical twenty-four foot arc at the top of the key. This eliminates NCAA constant use of "mini" rule changes. The shot distance gets longer as the player moves back down the court from eighteen to twenty-four feet;
- The length of the court is extended from ninety-four feet to one hundred feet for improved transition play;
- The basket height is increased to be used from ten feet one inch to fourteen feet depending upon the desired level of play for pre-college and college level. Pro-level of play will be between fifteen feet and fifteen feet eleven inches, the latter for special entertainment;
- The award for points "in the paint" is reduced from two to one point per basket for baskets made "inside the paint" during game play; and
- A four-point shot line has been incorporated into the court layout as illustrated in FIGS. 1A and 1B, increasing the use length twelve feet for offensive ball play. The "hail-mary" type shot is not been affected but added to its special effect.

Figure 2:
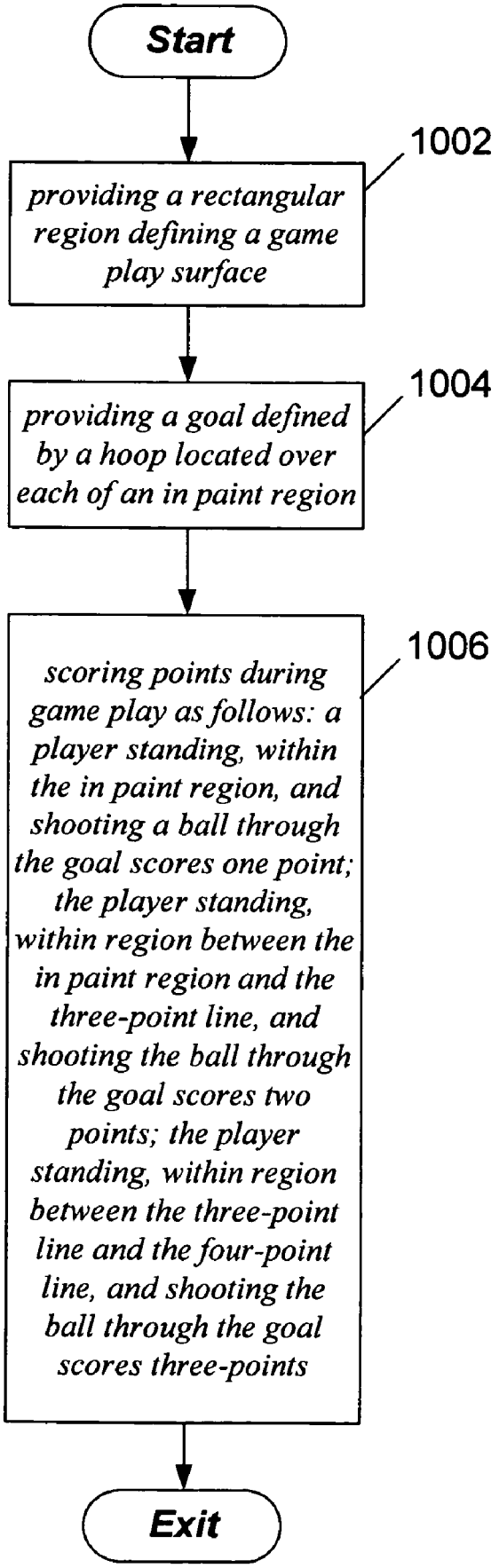
FIG. 2 illustrates one example of a method of preparing the court for game play and playing the game.

Referring to FIG. 2 there is illustrated one example of a method of preparing the court for game play and playing the game. The method begins in block 1002.

Block 1002 provides a rectangular region defining a game play surface. In this regard, two opposite sides of the rectangular region are an end line, a division line is disposed equal distance between each of the end line; each of an in paint region, a three-point line placed on the side of the in paint region and having an elliptical arc extending above the in paint region enhancing transition zone play between the three-point line and the division line, and a four-point line proximate the division line creating a four-point region are located within and at opposite ends of the game play surface.

In an exemplary embodiment, the game play surface is seventy feet by forty feet for general playground and elementary school team classifications; seventy feet by forty five feet for junior high school team classification; ninety feet by fifty feet for high school team classification; and one hundred feet by fifty feet for junior college, college divisions, and professional team classifications.

In an exemplary embodiment, the in paint region is disposed on the game play surface forming a region in close proximity to the goal, the in paint region being positioned to promote skilled and short player game play by deterring tall players from effectuating dunk type shot techniques that result when tall players shoot the ball through the goal while standing within the in paint region, by rewarding the lowest amount of points (one point) for such dunk type scoring shots. The method moves to block 1004.

Block 1004 provides a goal defined by a hoop located over each of an in paint region. In an exemplary embodiment, the fixed distance is ten feet one inch for general playground, elementary school, junior high school, and high school team classifications; eleven feet for junior college, college division NAIA team classifications; twelve feet for college division III team classification; thirteen feet for college division II team classification; fourteen feet for college division I team classification; fifteen feet for professional team classification; and fifteen feet eleven inches for professional assisted team classification. The method moves to block 1006.

Block 1006 scores points during game play as follows: a player standing, within the in paint region, and shooting a ball through the goal scores one point; the player standing, within region between the in paint region and the three-point line, and shooting the ball through the goal scores two points; the player standing, within region between the three-point line and the four-point line, and shooting the ball through the goal scores three-points; and the player standing, within the four-point region, and shooting the ball through the goal scores four-points.

In another exemplary embodiment a player can be allowed to advance the ball across the division line and then retreat with the ball to the opponents four point line before a back-court rule violation occurs. In this regard, the transition zone size is extended by the size of the opponents four point region. The method is then exited.

Figure 3:
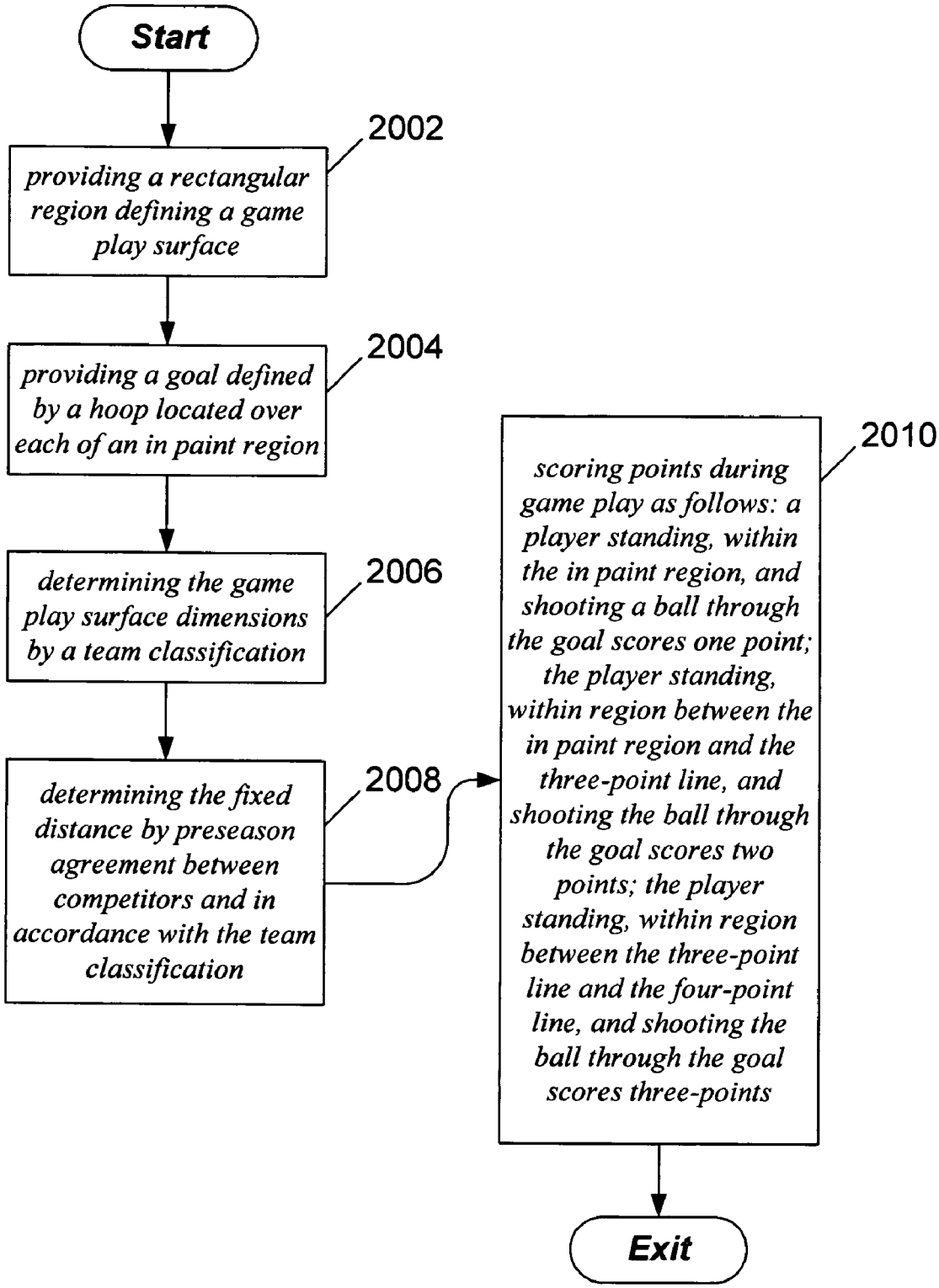
FIG. 3 illustrates one example of a method of preparing the court for game play and playing the game, wherein preparing the court includes determining the dimensions of the court and the height of the goal.

Referring to FIG. 3 there is illustrated one example of a method of preparing the court for game play and playing the game, wherein preparing the court includes determining the dimensions of the court and the height of the goal. The method begins in block 2002.

Block 2002 provides a rectangular region defining a game play surface. In this regard, two opposite sides of the rectangular region are an end line, a division line is disposed equal distance between each of the end line; each of an in paint region, a three-point line placed on the sides of the in paint region and having an elliptical arc extending above the in paint region enhancing transition zone play between the three-point line and the division line, and a four-point line proximate the division line creating a four-point region are located within and at opposite ends of the game play surface.

In an exemplary embodiment, the in paint region is disposed on the game play surface forming a region in close proximity to the goal, the in paint region being positioned to promote skilled and short player game play by deterring tall players from effectuating dunk type shot techniques that result when tall players shoot the ball through the goal while standing within the in paint region by rewarding the lowest amount of points (one point) for such dunk type scoring shots. The method moves to block 2004.

Block 2004 provides a goal defined by a hoop located over each of an in paint region. The method moves to block 2006.

Block 2006 determines the game play surface dimensions by a team classification. In an exemplary embodiment, the game play surface is seventy feet by forty feet for general playground and elementary school team classifications; seventy feet by forty five feet for junior high school team classification; ninety feet by fifty feet for high school team classification; and one hundred feet by fifty feet for junior college, college divisions, and professional team classifications. The method moves to block 2008.

Block 2008 determines the fixed distance by preseason agreement between competitors and in accordance with the team classification. In this regard, in an exemplary embodiment, the fixed distance is ten feet one inch for general playground, elementary school, junior high school, and high school team classifications; eleven feet for junior college, college division NAIA team classifications; twelve feet for college division III team classification; thirteen feet for college division II team classification; fourteen feet for college division I team classification; fifteen feet for professional team classification; and fifteen feet eleven inches for professional assisted team classification. The method moves to block 2010.

Block 2010 scores points during game play as follows: a player standing, within the in paint region, and shooting a ball through the goal scores one point; the player standing, within region between the in paint region and the three-point line, and shooting the ball through the goal scores two points; the player standing, within region between the three-point line and the four-point line, and shooting the ball through the goal scores three-points; and the player standing, within the four-point region, and shooting the ball through the goal scores four-points.

In another exemplary embodiment a player can be allowed to advance the ball across the division line and then retreat with the ball to the opponents four point line before a backcourt rule violation occurs. In this regard, the transition zone size is extended by the size of the opponents four point region. The method is then exited.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. An improved method of playing basketball, said improved method comprising:

transforming a rectangular region into a game play surface;

constructing said game play surface comprising: two opposite sides of said rectangular region are an end line, a division line is disposed equal distance between each of said end line, said game play surface dimensions are determined by a team classification; each of an in paint region, a three-point line placed on sides of said in paint region and having an elliptical arc extending above said in paint region enhancing transition zone play between said three-point line and said division line, and a four-point line proximate and parallel said division line creating a four-point region are located within and at opposite ends of said game play surface, a goal defined by a hoop located over each said in paint region, said hoop is located at a fixed distance above said in paint region;

setting said fixed distance minimum height as follows: said fixed distance is ten feet one inch for general playground, elementary school, junior high school, and high school said team classification; eleven feet for junior college, college division NAIA said team classification; twelve feet for college division III said team classification; thirteen feet for college division II said team classification; fourteen feet for college division I said team classification; fifteen feet for professional said team classification; and fifteen feet eleven inches for professional assisted said team classification;

recording a team score on a device during a game play time period; and scoring points during said game play time period comprising: a player standing, within said in paint region, and shooting a ball through said goal scores one point; said player standing, within region between said in paint region and said three-point line, and shooting said ball through said goal scores two points; said player standing, within region between said three-point line and said four-point line, and shooting said ball through said goal scores three-points; and said player standing, within said four-point region, and shooting said ball through said goal scores four-points.

2. The improved method in accordance with claim 1, wherein said in paint region is disposed on said game play surface forming a region in close proximity to said goal, said in paint region being positioned to promote skilled and short said player game play by deterring tall said player from effectuating dunk type shot techniques that result when said player shoots said ball through said goal while standing within said in paint region by rewarding lowest amount of points for such dunk type scoring shots.

3. The improved method in accordance with claim 1, further comprising:

forming, by disposing on said game play surface, said in paint region in close proximity to said goal, said in paint region being positioned to promote skilled and short said player game play by deterring tall said player from effectuating dunk type shot techniques that result when said player shoots said ball through said goal while standing within said in paint region, by rewarding lowest amount of points for such dunk type scoring shots.

4. The improved method in accordance with claim 1, further comprising:

coloring at least portion of said game play surface with a color, selected said color corresponds to selected said fixed distance height, wherein said goal height can be determined by said color disposed on at least portion of said game play surface.

5. The improved method in accordance with claim 1, further comprising:

setting said game play surface size as follows: said game play surface is seventy feet by forty feet for general playground and elementary school said team classification; seventy feet by forty five feet for junior high school said team classification; ninety feet by fifty feet for high school said team classification; and one hundred feet by fifty feet for junior college, college divisions, and professional said team classification.

6. The improved method in accordance with claim 1, further comprising:

allowing said player to advance said ball across said division line and then retreat with said bail to opponents said four point line before backcourt rule violation occurs, wherein transition zone size is extended by size of opponents said four point region.

* * * * *